United States Patent [19]

De Roure Olivier

[11] Patent Number: 4,643,305

[45] Date of Patent: Feb. 17, 1987

[54] METHOD FOR OBTAINING A WIRE COIL WOUND TO A VARIABLE DIAMETER WHICH IS PACKAGED ONTO A DISPLAY BACKING AND THE PRODUCT OBTAINED THEREBY

[75] Inventor: Pierre R. De Roure Olivier, Rougemont le Chateau, France

[73] Assignee: Manufacture de Rougement, France

[21] Appl. No.: 716,441

[22] Filed: Mar. 26, 1985

[30] Foreign Application Priority Data

Mar. 30, 1984 [FR] France ..... 84 05107

[51] Int. Cl.[4] ..... B65B 11/52; B65B 63/04

[52] U.S. Cl. ..... 206/388; 206/497; 53/427; 53/430; 242/174

[58] Field of Search ..... 53/430, 442, 433, 432, 53/453; 206/388, 389, 497; 242/166, 167, 173, 174, 178

[56] References Cited

U.S. PATENT DOCUMENTS

| | | | |
|---|---|---|---|
| 943,202 | 12/1909 | Struss | 206/389 |
| 1,431,352 | 10/1922 | Abbott | 206/389 |
| 2,183,876 | 12/1939 | Sullivan . | |
| 2,265,246 | 12/1941 | Ott | 242/174 X |
| 2,713,938 | 7/1955 | Snyder | 53/430 X |
| 2,973,911 | 3/1961 | Rayburn | 53/430 X |
| 3,127,012 | 3/1964 | Smoot | 206/389 |
| 3,175,679 | 3/1965 | Bratz | 206/389 |
| 3,253,705 | 5/1966 | Stoker | 206/497 |

FOREIGN PATENT DOCUMENTS

| | | |
|---|---|---|
| 2505638 | 11/1982 | France . |
| 7510786 | 12/1975 | Netherlands . |

*Primary Examiner*—Horace M. Culver

*Attorney, Agent, or Firm*—Berman, Aisenberg & Platt

[57] ABSTRACT

The wire coil wound to a variable diameter which is packaged onto a display backing in the form of a card (3) has groups of turns of different diameters which are stacked by being overlapped according to an increasing or decreasing diameter pattern meeting the relation $E=D_o \pm 2\ n\ \phi$ where E is the increasing or decreasing winding, $D_o$ is the initial coil diameter, n is a positive integer and $\phi$ is the wire diameter.

15 Claims, 5 Drawing Figures

METHOD FOR OBTAINING A WIRE COIL WOUND TO A VARIABLE DIAMETER WHICH IS PACKAGED ONTO A DISPLAY BACKING AND THE PRODUCT OBTAINED THEREBY

This invention relates to a method for obtaining a wire coil wound to a variable diameter which is packed onto a display backing and the product obtained thereby.

The wire coil wound to a variable diameter which is packed onto a display backing will be termed a bundle in the following disclosure.

The need frequently arises to use for various purposes a small amount of wire.

Thus, it would be most convenient to keep available some amount of wire suitably packed onto a display backing without involving thereby a prohibitive cost.

Known in the prior art are wire coils contained in rigid shells but once the shell is torn away the wire or rather the coil is no longer held on the display backing. Moreover, a rigid shell involves a socket or cap made of rigid plastic which is of quite substantial cost.

Also known in the prior art are wire coils wrapped in semi-rigid sheaths. In this case, too, once the sheath is torn away, the coil can no longer be kept on the backing.

As far as the applicant knows, all the embodiments according to the prior art include wire coils wound to a constant diameter disposed within rigid or semi-rigid shells or sheaths.

FR-A-2 505 638 describes and illustrates a display backing for a cable coil. The display backing comprises a shell and a cover. The shell is a semi-rigid shell made of plastic, e.g. polyvinyl chloride (PVC). The cover is a flexible film which is adhered under heating to the projecting portions of the shell. The shell comprises a retaining cap having the coil disposed therein. This display backing involves the use of a semi-rigid shell of relatively high cost. Said display backing does not include a card having thereon the coil which is held and surrounded by a thin, flexible film fitting all its apparent surfaces as set forth in the following description of the present invention.

U.S. Pat. No. 2,183,876 described and illustrates a wire coil wound into a so-called "pancake" shape.

According to this embodiment the first turn is larger than the following turn which is larger than the third following turn and so on to a $n^{th}$ turn whereafter the $n^{th}$ turn is smaller than the following turn which is smaller than the next following turn etc . . . . When flattening a so-called "pancake" shaped structure, two layers of wire will be obtained as shown in FIG. 2. The two layers of wire are subsequently attached by ties. There is no mention in U.S. Pat. No. 2,183,876 of a wire coil packed onto a backing assuming the shape of a card.

The purpose of the present invention is to solve the problem set forth hereafter, namely to obtain a packing under minimum bulk of a predetermined amount of wire in the form of a coil which is applied onto a flat backing of a given surface area while being easy to unwind from the display backing without tearing away the whole film so that in use the bundle may be held on the display card.

It should be noted that the wire contemplated in the present invention is round wire and not a wire reinforced tape to be used for example as a fastener or tie.

The present invention therefore has for its object a method for obtaining a wire coil wound to a variable diameter which is packed onto a display backing in the form of a card which is characterized by the steps of:

(a) winding at least one group of turns at an increasing or a decreasing diameter according to a pattern complying with the relation $E=D_o\pm 2n\phi$ where E is the increasing or decreasing winding, $D_o$ is the initial diameter of the first turn, n is a positive integer and $\phi$ is the diameter of the wire (b) spreading out and heating a thin plastic film so as to stretch and soften it (c) disposing opposite the film a porous substrate having placed thereon the coil of wire wound according to (a), one end of the wire in contact with the substrate being extended away from the first turn applied on the substrate (d) applying the plastic sheath on the substrate and exerting a suction from below the substrate for thereby causing the plastic sheath to take the exact shape of the wire coil wound to a variable diameter and sticking the sheath to the substrate.

The present invention also relates to a wire coil wound to a variable diameter which is packed onto a display backing in the form of a card, said coil being held in place and surrounded by a protective sheath consisting of a thin, flexible film fitting all its apparent surfaces and in engagement with the display backing both in the area inside said coil and in the area outside the same, one wire end in contact with the card being extended away from the first turn applied onto said card to permit controlled unwinding of the wire from the inside of the coil thanks to the braking action caused by the adhesion of the film to the coil turns which is characterized in that it has groups of turns of different diameters which are stacked by being overlapped according to a pattern of increasing or decreasing diameter.

The present invention also relates to the following features taken separately or according to every technically feasible combination thereof:

- the increasing diameter pattern of the turns corresponds to the increasing winding relation $EC=D_o+2n\phi$ where $D_o$ is the intial diameter of the first turn, n is a positive integer and $\phi$ is the diameter of the wire.
- the decreasing diameter pattern of the turns corresponds to the decreasing winding relation $ED=D_o-2n\phi$ where $D_o$ is the initial diameter of the first turn, n is a positive integer and $\phi$ is the diameter of the wire.
- the diameter of the wire ranges from 0.3 to 2.5 mm.
- the wire is a galvanized wire.
- the wire is a round wire coated with a plastic coating.
- the wire is a brass wire.
- the wire is a stainless steel wire.
- the bundle has a wire length ranging from 5 to 25 meters.
- the flexible film is a plastic having a thickness of about 80 microns.
- the film is made of polyethylene, PVC and the like.

Various advantages and features of the present invention will become apparent from the following detailed description with reference to the appended drawings wherein.

Figure 2:
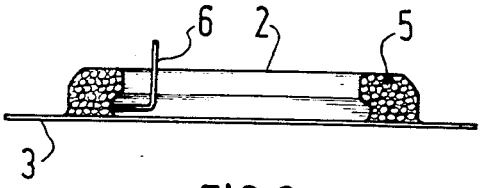
FIG. 2 is a section taken along line A—A of FIG. 1.
Figure 1:
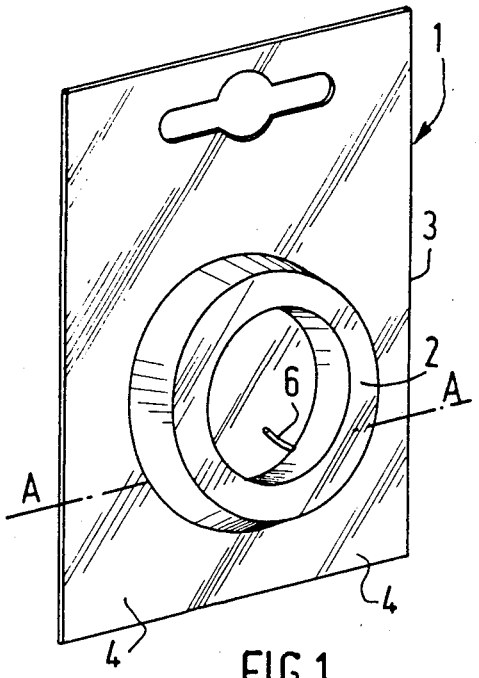
FIG. 1 is a perspective view of a coil or bundle according to the present invention as packed onto a display card.
Figure 3:
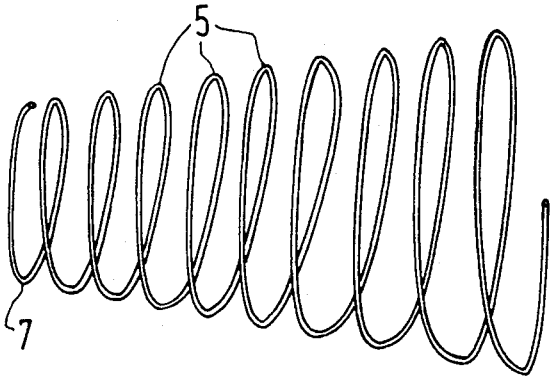
FIG. 3 is a side view of an expanded bundle.
Figure 4:
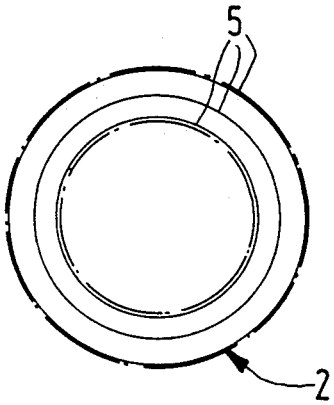
FIG. 4 is a front view of a bundle according to the invention which is not packed onto a display card.

In the appended drawings wherein the same reference symbols designate similar parts, the wire coil or bundle wound to a variable diameter which is packed onto a display backing is generally designated 1. The coil or bundle is designated 2. It is applied onto a display backing or card 3 and is surrounded by a protective sheath 4 consisting of a thin, flexible film fitting all its apparent surfaces and engaging the display backing or card 3 both in the area inside said coil 2 and in the zone outside the same. Coil 2 consists of one or more groups of turns 5 wound at a non constant or variable diameter as will be explained hereafter. One end 6 of the wire in contact with the card 3 is extended away from the first turn 7 applied against card 3 to allow controlled unwinding of the wire from the interior of the bundle 2 thanks to the braking action caused by the adhesion of film 4 to the turns 5 of bundle 2.

The bundle 2 comprises groups of turns 5 of different diameters which are stacked by being overlapped according to a pattern of increasing or decreasing diameter.

The increasing diameter pattern of turns 5 corresponds to the increasing winding relation $EC=D_o+2n\phi$ where $D_o$ is the initial diameter of the first turn 7, n is a positive integer and $\phi$ is the diameter of the wire.

Considering an example of manufacture with a wire having a diameter $\phi$ of 1 mm and an initial diameter $D_o$ of 80 mm, the winding step is effected with n turns at 80 mm then n turns at 80+2 times $\phi$ viz. 82 mm then n turns at 80+4 times $\phi$ viz. 84 mm and so on.

Similarly, but in reversed manner, there may be obtained a decreasing diameter pattern of the turns 5 corresponding to the decreasing winding relation $ED=D_o-2n\phi$ where $D_o$ is the initial diameter of the first turn, n is a positive integer and $\phi$ is the diameter of the wire. In this case the respective values will be for example fo 80 mm, 78 mm, 76 mm, etc . . . for each turn or group of successive turns.

The considerable advantage afforded by such a winding at a diameter increasing or decreasing by individual turns or by groups of turns lies in that the turns 5 are overlapped about each other. There is thus obtained a highly homogenous bundle 2 is self-maintained without any tying to the display backing 3 before application of the sheath 4. The bundle 2 will unwind from the inside starting from end 6 without complete tearing off of the sheath 4 and without any risk of entanglement of the turns 5. In the example shown in the drawings, once the turn or turns of the smallest diameter have been unwound, those of the next higher diameter are unwound and so on.

Figure 5:
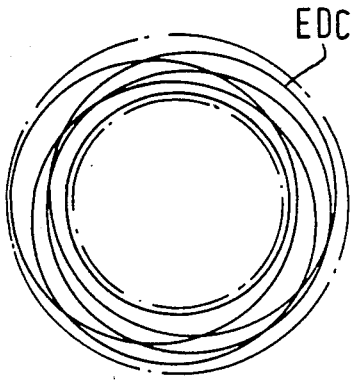
FIG. 5 is a front view of a constant winding coil according to the previous art.

Due to the overlapping arrangement of the turns 5, the depth of the bundle 2 is less than in the case of a constant diameter winding EDC such as shown in FIG. 5.

In general the wire length of a bundle 2 according to the invention is preferably of about 8 meters.

With such a length of wire it would not be possible to obtain a satisfactory product packed onto a display backing if the winding were regular and constant since the sheath 4 would tend to get locally blistered due to the nature of the round wire and due to the great depth required.

The construction according to the present invention leads to extremely important and advantageous savings on the cost. There may thus be packed onto a display card any predetermined amount of wire due to the mutual overlapping of the turns 5. Another advantage to be pointed out is that of storage, each display card has a much reduced bulk with the construction according to the present invention.

Once the bundle 2 has been shaped and wound as set forth above, it is placed on the display backing 3, due to its condition, it will be self-maintained. The end 6 is moved somewhat apart from the first turn, then a thin plastic film is spread out and heated so as to stretch and soften it. A suction is then applied from below the display backing to cause the plastic sheath to assume the shape of the bundle 2 and to rigidly hold the latter in place on the display card 3.

I claim:

1. A method for obtaining a wire coil wound to a variable diameter which is packed onto a display backing in the form of a card characterized by the steps of (a) winding a plurality of groups of turns at an increasing or a decreasing diameter according to a pattern complying with the relation $E=D_o\pm 2n\phi$ where E is the increasing or decreasing winding, $D_o$ is the initial diameter of the first turn, n is a positive integer and $\phi$ is the diameter of the wire (b) spreading out and heating a thin plastic film so as to stretch and soften it (c) disposing opposite the film a porous substrate having placed thereon the coil of wire wound according to (a), one end of the wire in contact with the substrate being extended away from the first turn applied on the substrate (d) applying the plastic film on the surbstrate and exerting a suction from below the substrate for thereby causing the plastic film to take the exact shape of the wire coil wound to a variable diameter and sticking the film to the substrate.

2. A wire coil wound to a variable diameter which is packed onto a display backing in the form of a card, obtained by the method according to claim 1, said coil held in place and surrounded by a protective sheath consisting of a thin, flexible film fitting all its apparent surfaces and in engagement with the display backing both in the area inside said coil and in the area outside the same, one wire end in contact with the card being extended away from the first turn, applied onto said card to permit controlled unwinding of the wire from the inside of the coil thanks to the braking action caused by the adhesion of the film to the turns of the coil, characterized in that it has groups of turns of different diameters which are stacked by being overlapped according to a pattern of increasing or decreasing diameter.

3. A coil according to claim 2, characterized in that the increasing diameter pattern of the turns corresponds to the increasing winding relation $EC=D_o+2n\phi$ where $D_o$ is the initial diameter of the first turn, n is a positive integer and $\phi$ is the wire diameter.

4. A coil according to claim 2, characterized in that the decreasing diameter pattern of turns corresponds to the decreasing winding relation $ED=D_o-2n\phi$ where $D_o$ is the initial diameter of the first coil, n is a positive integer and $\phi$ is the wire diameter.

5. A coil according to claim 2, characterized in that the wire diameter is in the range from 0.3 to 2.5 mm.

6. A coil according to claim 5, characterized in that the wire is a galvanized wire.

7. A coil according to claim 5, characterized in that the wire is a round wire coated with a plastic coating.

8. A coil according to claim 5, characterized in that the wire is a brass wire.

9. A coil according to claim 5, characterized in that the wire is a stainless steel wire.

10. A coil according to claim 5, characterized in that its wire length is in the range of 5 to 25 meters.

11. A coil according to claim 2, characterized in that the flexible film is a plastic having a thickness of about 80 microns.

12. A coil according to claim 11, characterized is that the film is made of polyethylene.

13. A wire coil wound to a variable diameter and which is packed on a display backing in the form of a card, the coil being held in place and surrounded by a protective sheath consisting of a thin, flexible film fitting all its apparent surfaces and in engagement with the display backing both in the area inside said coil and in the area outside of same, one wire end being in contact with the card, being extended away from the rest of the wire coil and being within an area circumscribed by the coil; the wire coil being wound and applied on the card in a manner which permits controlled unwinding of the wire from the one wire end from inside of the coil, which has groups of turns of different diameters which are stacked by being overlapped according to a pattern of increasing or decreasing diameter; adhesion of the film to the turns of the coil providing a braking action which permits withdrawal of a selected amount of wire from the coil without destroying the integrity of the remaining coil.

14. A method of using the protective sheath surrounding a wire coil as claimed in claim 13 as a brake, which comprises withdrawing a selected amount of wire from the coil by pulling on the one wire end until a sufficient length of wire is so withdrawn, and cutting off the thus-withdrawn length of wire, whereby the protective sheath acts as a brake and retains intact the amount of wire not so withdrawn.

15. A method which comprises securing a wire coil on a display backing with a protective sheath consisting of a thin, flexible film fitting all apparent surfaces of the wire coil and in engagement with the display backing both in the area inside said coil and in the area outside of same, the wire coil having one end which is in contact with the display backing, which is extended away from the rest of the wire coil and which is within an area circumscribed by the coil; withdrawing a length of wire from the coil by pulling the one wire end through the protective sheath until a desired length of wire is withdrawn from the coil; and cutting off the desired length of wire; whereby the protective sheath acts as a brake and retains wire not so withdrawn as an integral wire coil.

* * * * *